United States Patent [19]

DeLucia et al.

[11] 4,039,984

[45] Aug. 2, 1977

[54] PRESSURIZED RELAY ASSEMBLY

[75] Inventors: Victor E. DeLucia, Santa Monica; Philip B. Nosser, Los Olivos, both of Calif.

[73] Assignee: Torr Laboratories, Inc., Van Nuys, Calif.

[21] Appl. No.: 665,903

[22] Filed: Mar. 11, 1976

[51] Int. Cl.[2] ..... H01H 1/66

[52] U.S. Cl. ..... 335/151; 335/202; 339/100

[58] Field of Search ..... 335/151, 154, 202; 339/100

[56] References Cited

U.S. PATENT DOCUMENTS

| | | | |
|---|---|---|---|
| 3,071,751 | 1/1963 | Horndasch | 339/100 |
| 3,175,176 | 3/1965 | Henschke | 339/100 X |
| 3,296,568 | 1/1967 | Griggs et al. | 335/154 |
| 3,891,950 | 6/1975 | DeLucia | 335/154 |

*Primary Examiner*—George Harris

[57] ABSTRACT

A high-voltage magnetic relay enclosed within a housing of insulating material which contains a gas, such as sulfur hexafluoride. The terminals within the housing extend through its wall and are secured to the housing in sealed relation thereto to prevent gas from leaking from the housing. Leads are connected to the terminals externally of the housing, with insulating material surrounding the leads and being secured by the terminals to the housing. An operating mechanism within the housing shifts a pivoted arm electrically connected to one of the terminals within the housing into and from contact with another of the terminals within the housing.

20 Claims, 9 Drawing Figures

PRESSURIZED RELAY ASSEMBLY

The present invention relates to a relay assembly wherein the relay contacts and terminals are enclosing within a housing filled with a pressurized dielectric gas, such as sulfur hexafluoride, the relay terminals projecting through the housing, with seals between the terminals and housing preventing gas leakage from the housing. explosion As disclosed in U.S. Pat. No. 3,604,870, magnetic relay assemblies have been provided, including a glass envelope or housing containing a magnetically operated switching mechanism the envelope containing a pressurized dielectric gas. The glass envelope of such assemblies is subject to cracking under internal pressures ranging from 1 to 5 atmospheres. It is also subject to expoosion because of the internal pressure. Moreover, the making of the envelope of glass requires numerous and complex manufacturing operations to insure leakproof and safe operation of the relay assembly.

Some of the difficulties and disadvantages of glass envelope relay assemblies have been overcome by the magnetic relay assembly disclosed in U.S. Pat. No. 3,891,850, in which the envelope or housing is made of metal. However, the insulating of the assembly terminals from the metallic housing requires a relatively large number of parts, is complex, and increases the cost of manufacture.

By virtue of the present invention, the envelope or housing of the magnetic relay assembly is made of insulating material which enables the relay terminals to be sealed directly to the housing without the intervention of additional insulating parts. As a result, the relay assembly is much simpler than prior assemblies and more economical to produce. The housing has high impact strength, which is much greater than that of glass, greatly reducing, if not eliminating entirely, the likelihood of the housing to crack, or otherwise fail, and insuring against leakage from the housing of the pressurized gas. The housing is transparent, which facilitates assembly of the relay. It also has high heat resistance. Because of its simplicity and high strength, the entire relay assembly is compact and lighter than prior relay assemblies.

The invention also includes a simpler manner of connecting the relay terminals to the leads externally of the housing. The manner of connection results in the housing itself insulating the terminal portions externally of the housing and also the lead portions where they connect to the external terminal portions, reducing arcing across terminals, since the housing portion surrounding the leads increases electrical creep resistance. The prevention of arcing is important with relays operating at high voltage, such as 7500 volts at which a relay operates in a DC defibrillator. Relay of the type disclosed herein may operate at voltages ranging from about 100 to 30,000 volts.

With the present invention, the manner of connecting each relay terminal to its associated lead not only insures good electrical contact between the terminal and lead, but also expands the insulation surrounding the lead into firm gripping engagement with the insulating housing, preventing inadvertent disconnection between the lead and terminal while, as noted above, providing an arrangement in which the housing itself increases the insulation of the lead in the region of its connection to the terminal.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 3:
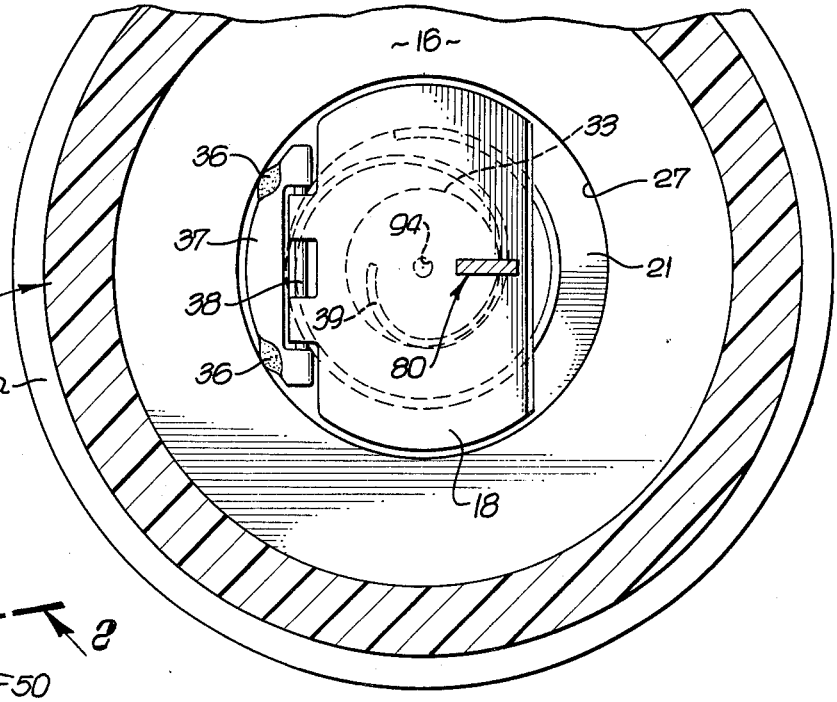
FIG. 3 is a horizontal section taken along the line 3—3 of FIG. 2.
Figure 1:
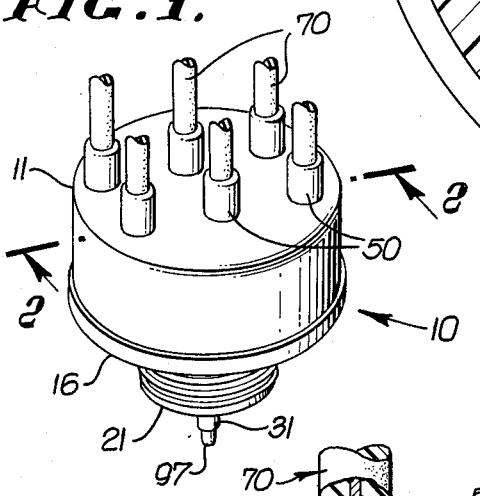
FIG. 1 is a perspective view illustrating a pressurized relay assembly made in accordance with the invention.
Figure 2:
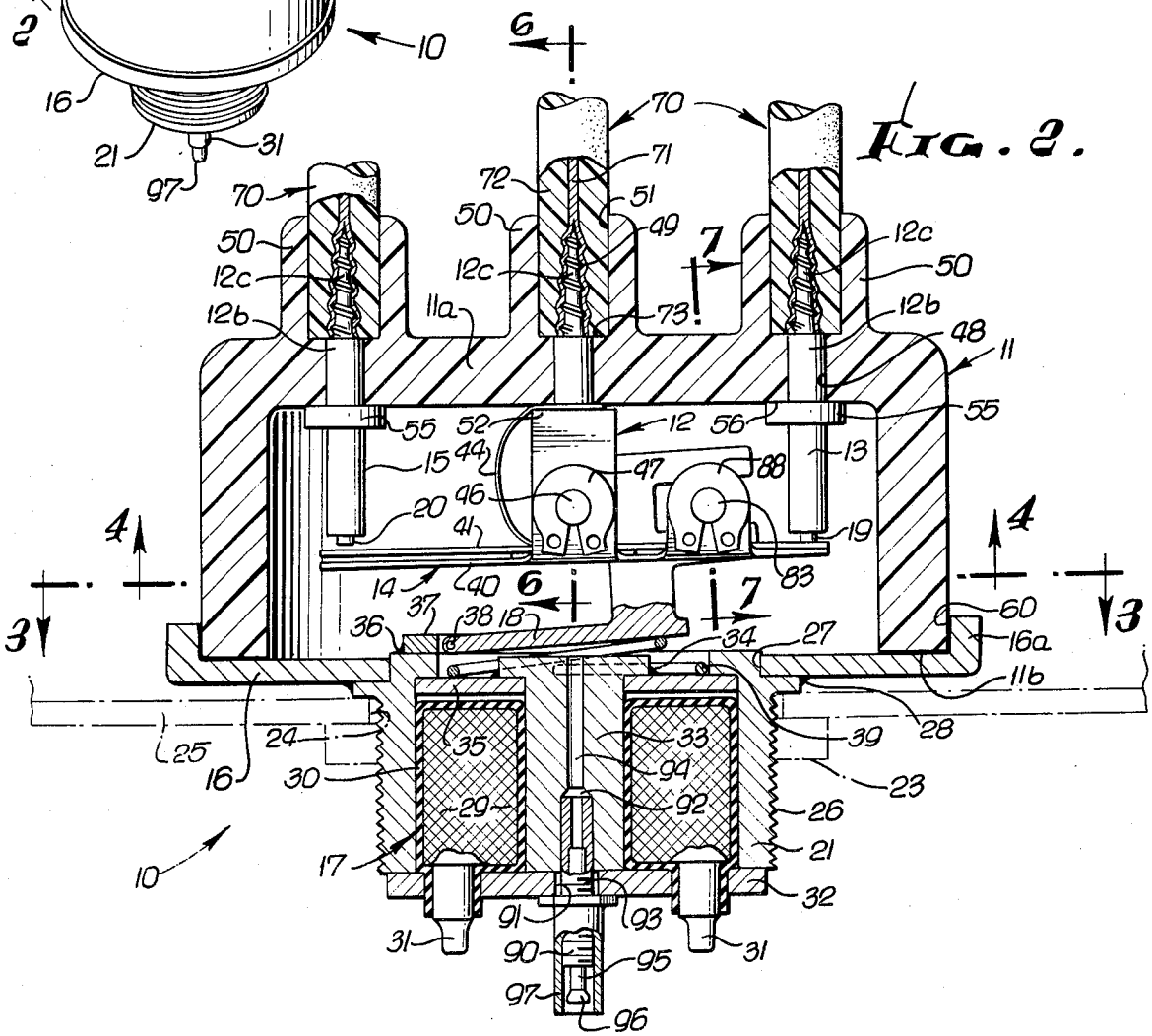
FIG. 2 is an enlarged vertical section taken along the line 2—2 on FIG. 1.
Figure 4:
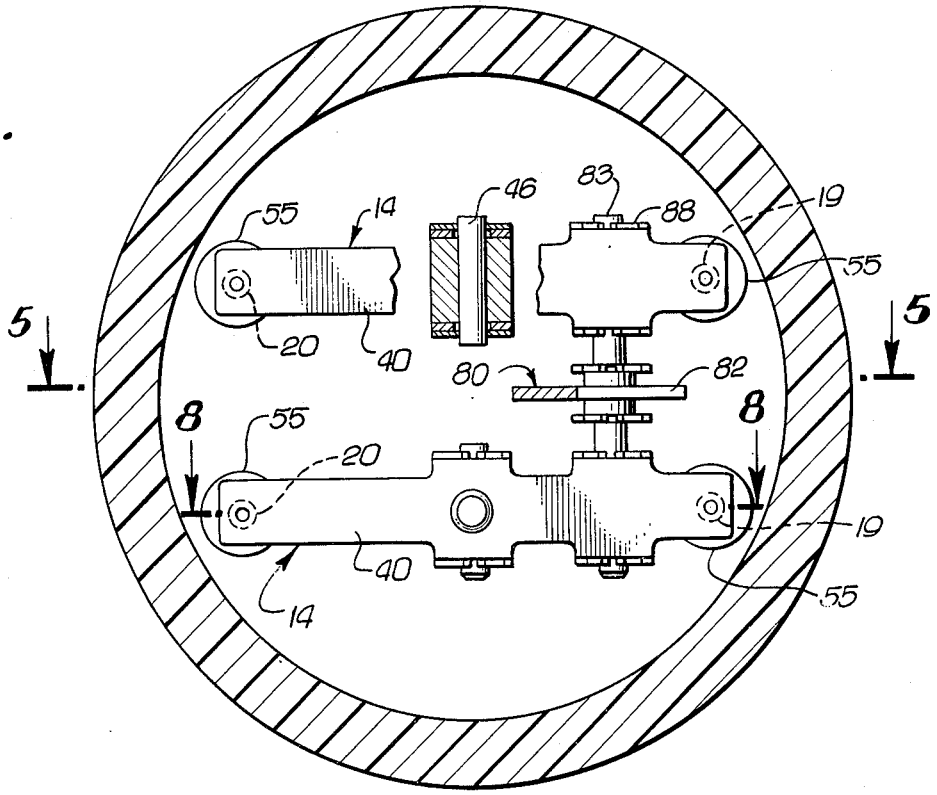
FIG. 4 is a horizontal section taken along the line 4—4 on FIG. 2.
Figure 5:
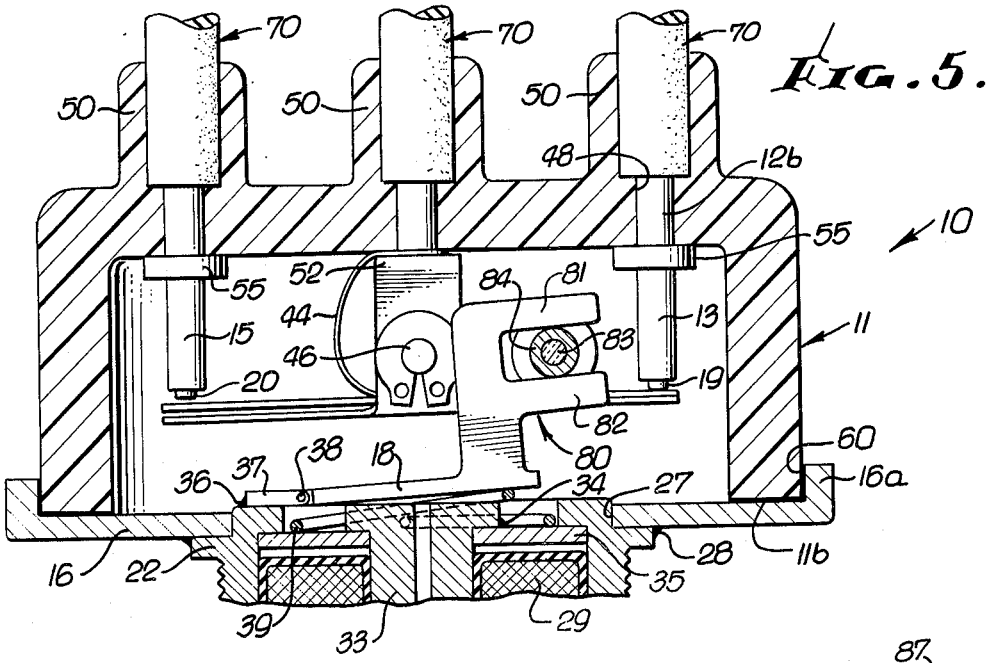
FIG. 5 is a vertical section taken along the line 5—5 of FIG. 4, with certain parts broken away.
Figure 9:
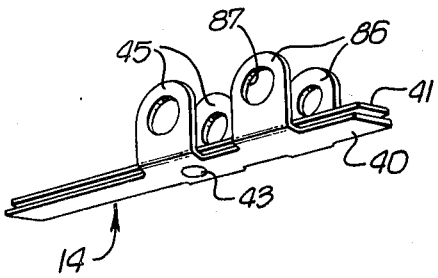
FIG. 9 is a detail view in perspective of the spring contact unit.
Figure 6:
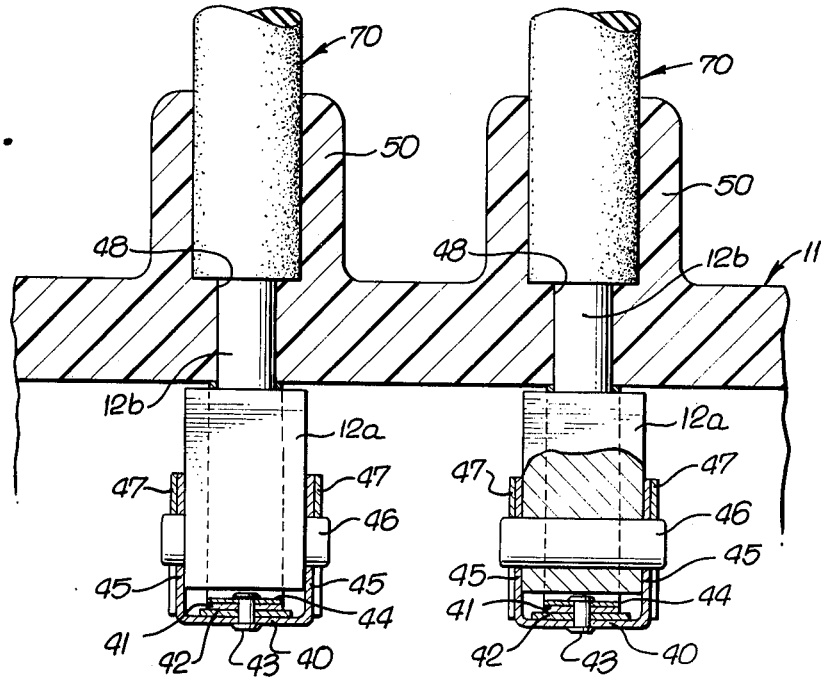
FIG. 6 is a fragmentary vertical section, on an enlarged scale, taken along the line 6—6 of FIG. 2.
Figure 7:
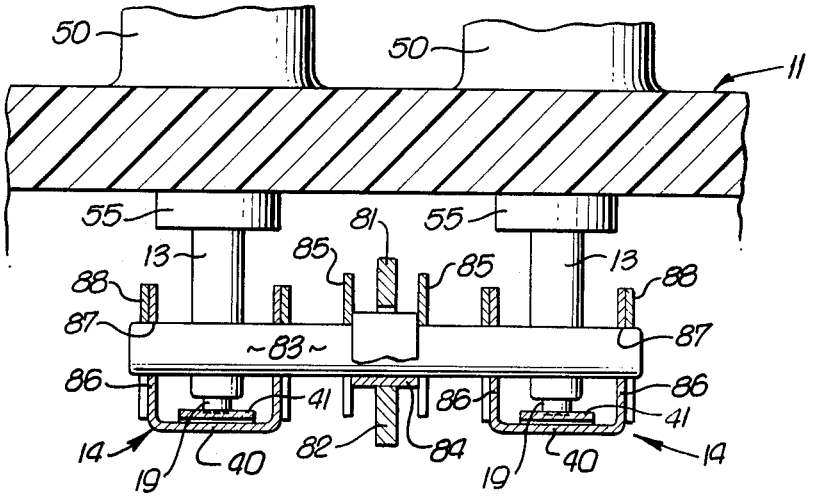
FIG. 7 is a fragmentary vertical section, on an enlarged scale, taken along the line 7—7 on FIG. 2.

As illustrated in the drawings, the relay assembly 10 includes a hollow cylindrical housing member 11 from the top 11*a* of which six terminals are supported. These include a pair of common terminals 12 on which spring contact arms are pivotally mounted, a pair of terminals 13 that are normally contacted by contact arms 14 to close the circuit between the common terminals 12 and the terminals 13, and another pair of terminals 15 which are normally out of contact with the spring contact arms 14. The base of the housing 11 is closed by a metal plate 16 secured to the housing in the manner described hereinbelow, the plate being secured to an electromagnet 17 adapted to effect oscillation of an actuator arm 80 and pivotal movement of the contact arms 14 to produce alternate engagement of the end portions 14 the arms with internal contact tips 19, 20 of either the terminals 13 or the terminals 15.

The electromagnet 17 includes a coil housing 21 having an outer mounting flange 22 engaging the plate 16 and adapted to cooperate with a typical mounting nut 23 to support the relay assembly in an opening 24 in a supporting plate 25 when the nut is threaded onto the coil housing threads 26. The coil housing is disposed in an opening 27 in the housing closure plate 16 and is secured in place by brazing material 28. Within the housing is an electromagnetic coil 29 covered by insulating material 30 and having coil terminals 31 projecting through a soft iron lower end plate 32 of the coil housing. Within the magnetic coil is a soft iron core 33 having an inner head affixed by brazing material 34 to an inner core support plate 35 of non-magnetic material, such as Monel. Internally of the housing 11 and suitably affixed to the core housing, as by brazing material 36, is a support bracket 37 for the actuator arm 18, the arm being pivotally connected to the bracket by a pivot pin 38.

Disposed between the actuator arm 18 and the core plate 35 is a coil spring 39 acting normally to pivot the actuator arm 18 away from the magnetic assembly 17. However, when the magnetic assembly is energized, the actuator arm 18, which is composed of magnetic material, such as soft iron, is pulled downwardly.

Figure 8:
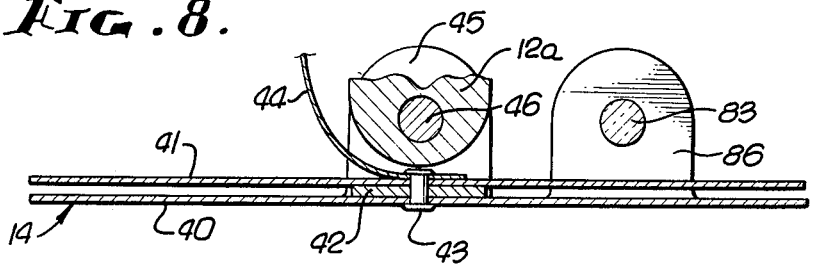
FIG. 8 is a fragmentary section, on an enlarged scale, taken along the line 8—8 on FIG. 4.

The contact arms 14 are of resilient conductive material, such as molybdenum, and are pivotally supported between their ends beneath the common terminals 12. Each contact arm is an assembly of a lower leaf spring element 40 and an upper leaf spring element 41 spaced apart by a central spacer 42 and fastened together by a rivet 43 (FIG. 8) or the like, to which is also secured a flexible conductive lead or loop 44 engaging the upper leaf element, the upper end of which is in contacting relation to the common terminal 12, in the manner described hereinbelow. The lower leaf spring 40 has upstanding support ears 45 at opposite sides between which is disposed the inner portion 12*a* of the terminal 12, a pivot pin 46 extending through the ears and the terminal, with the assembly being held together by resilient grip rings 47 expansible by a known applicator tool for mounting on the end portions of the pivot pin 46.

Each common terminal includes an intermediate cylindrical rod portion 12*b* fitting within a cylindrical bare 48 extending through the top of the housing 11, the terminal including an upper tapered pin portion 12*c* having threads 49 extending within a reentrant housing boss 50 which extends upwardly from, and is integral with, the main portion of the housing top 11*a*. This boss has a larger internal diameter than the diameter of the rod portion 12*b* and pin 12*c*, providing an annular space 51 between the tapered pin and the inner wall of the boss.

Each common terminal 12 is secured to the housing top by a suitable adhesive, which also functions as a seal between the terminal housing to prevent leakage of gas from the housing around the terminal. Such adhesive sealant is an epoxy resin applied to the periphery of the rod portion 12*b* and the opposed wall of the housing bore 48, and also to the terminal shoulder 52 at the lower end of the rod portion, the upper portion of the loop 44, and the adjacent inner surface of the housing top 11*a*. Such resin, when it sets and hardens, firmly anchors the common terminal 12 the housing 11 and seals the common terminal with respect to the top 11*a* of the housing, the tapered end 12*c* projecting upwardly into the reentrant boss 50.

Each common terminal is assembled and secured to the housing in leakproof relation with respect thereto in the same manner as the common terminal just described. This is also true of all the other terminals 13, 15, each of which has a flange 55 that engages the inner side 56 of the housing top 11*a*, and also the cylindrical rod portion 12*b* that fits closely within a companion bore 48 through the housing top that opens into the reentrant boss 50 integral with the housing top, as well as a tapered threaded pin 12*c* in such reentrant boss. The epoxy resin effects a coating between the flange 55 and the inner side of the top 11*a*, as well as between the entire cylindrical periphery of the rod portion 12*b* and the opened wall of the housing bore 48, not only to securely attach each terminal 13 or 15 to the top 11*a*, but to seal it within the top against leakage of the high-pressure gas from the housing, such as gas being introduced in the manner described below.

An adhesive sealant, such as an epoxy resin, is also used for securing the plate 16 to the housing structure 11, sealing such parts to one another against leakage. The epoxy resin is provided between the lower end 11*b* of the housing and the plate 16, as well as between the inner wall 60 of the plate skirt 16*a* and the periphery of the housing which it encompasses. When the resin sets and hardens, it will rigidly secure the plate 16 to the housing 11, and also provide a seal around the entire lower end 11*b* of the housing and the confronting annular portion of the plate, as well as around the entire circumference of the inner wall 60 of the skirt 16*a* and the opposed peripheral surface of the housing 11.

After the terminals 12, 13, 15 have been affixed in sealed relation to the housing 11, a conductive lead 70 can be connected to each terminal. As disclosed, each lead includes a central conductor portion 71 surrounded by an insulator portion 72. Each lead is moved downwardly within a reentrant boss 50 and is turned so as to thread it around the tapered pin 12*c* of the conductor, the insulation 72 also moving into the reentrant boss. The outside diameter of the lead insulation is initially only slightly less than the inside diameter of the reentrant boss 50, so that the threading of the lead along the tapered pin 12*c* of the terminal causes the pin to expand the insulation material 72 and force it firmly and securely against the inner wall of the reentrant boss. The lead is threaded downwardly along the tapered pin to its fullest extent, as determined by engagement of the end of the insulation 72 with the upper surface 73 of the housing top at the base of the reentrant boss. The threaded connection between the conductor 71, and pin 12*c* provides proper contact between the conductor and pin over a large area.

Each of the terminals is sealed within the housing in the manner above-described. In the case of the normally open terminal 15, its contact point or tip 20 is disposed for engagement by the upper contact spring 41 upon energization of the magnet coil 29. The normally closed terminal 13 has its inner contact point or tip 19 normally engaged by the upper leaf spring 41, until the magnet coil is energized, which disengages the spring from the tip 19.

To secure pivotal movement of the contact arms 14 so that they either engage the contact points 19 of the terminals 13 or the contact points 20 of the terminals 15, the actuator arm 18 has a yoke 80 at its free end comprising a pair of upper and lower fingers 81, 82 disposed above and below a transverse insulating rod 83 which is connected with the respective contact arms 14 so as to shift them between their alternate positions. On the rod 83 is a wear bushing or sleeve 84 disposed between the fingers 81, 82 of the yoke and maintained in place by a pair of laterally spaced resilient grip rings 85 applied to the rod 83. Each of the lower leaf springs 40 of each contact arm assembly 14 has a pair of upstanding ears 86 provided with aligned openings 87 through which the insulator rod 83 extends. Additional resilient grip rings 88 are applied to the rod for engagement with the ears 86 of each leaf spring 40 to retain the rod and leaf spring in assembly. It will be apparent that energization of the electromagnet 17 and deenergization thereof will cause the contact arms 14 to be actuated between their normally closed and normally open positions by the yoke member 80 of the actuator arm 18, and the rod 83 which engages the ears 86 of the contact arms 14 at a location spaced from the pivot pins 46 of the contact arms so as to afford a mechanical advantage.

Since the entire housing 11 is now sealed, its interior chamber portion can be pressurized to the desired pressure, which, for example, can be from about 1 to 5 atmospheres, with sulfur hexafluoride, or other dielectric gas. Pressurization of the housing is accomplished by a fitting comprising an external threaded bushing 90 which extends through an opening 91 in the magnet end plate 32 and into a bore 92 which communicates with another passage 94 in the magnet core leading into the relay housing. Disposed in the bushing is a tube 95 through which the dielectric gas can be supplied to the housing prior to crimping the outer end 96 of the tube to close it to maintain the gas within the housing. A suitable cap 97 is preferably threaded on the bushing 90 to protect the tube 95.

The housing 11 is made from a material that has high impact strength and high heat resistance. Among the materials that can be used are polyamide or polycarbonate resins. Such materials are transparent, which enables the interior of the housing to be visible for the purpose of facilitating assembly of the parts within the housing. By the simple expedient of employing an epoxy or similar adhesive resin for firmly securing the terminals 12, 13, 15 in leakproof relation to the housing 11 and of the metallic plate 16 to the insulating housing, a greatly reduced number of parts is required than was heretofore necessary in the production of a relay assembly, the relay assembly being much simpler than the prior assemblies, and more economical to produce. In addition, the relay assembly is lighter than prior assemblies.

The leads 70 are firmly and securely attached to the terminals, the leads being frictionally secured in the reentrant boses 50 by the expansion effect of the tapered pins 12c, forcing the lead insulation 72 into strong frictional gripping engagement with the inner wall of each boss 50. The fact that the reentrant bosses surround the terminals and the portions of the leads within the reentrant boss as provides additional insulation which greatly reduces the tendency of arcing to occur across the terminals due to the increased electric creepage path; that is, the creep resistance is increased because of the surrounding of the tapered pins 12c of the terminals and of the leads by the insulating reentrant bosses 50, which, it is to be noted, are integral with the main portion of the housing 11 of insulting material.

The flexible loop 44 affords a direct interconnection between each common terminal 12 and the contact arms 14, providing a direct and more positive path for a current to pursue in traveling between each of the common terminals and the contact arms 14. Accordingly, reliance need not be placed entirely upon the frictional contact between the ears 45 of the lower leaves 40 and the pivot pin 46 for conducting electric current between the parts.

We claim:

1. A relay comprising a housing of electrical insulating synthetic resin material, terminals in said housing extending through the housing to the exterior thereof, at least one of said terminals providing a contact within said housing, a contact arm within said housing connected to another of said terminals, electromagnetic operating means for engaging said contact arm with said terminal contact and for disengaging said contact arm from said terminal contact, bonding means on and between said housing and each terminal to secure said terminals to said housing and to provide a leakproof seal between said terminals and housing, and means for admitting a gas into said housing.

2. A relay as defined in claim 1; said bonding means comprising an adhesive coating applied directly to said terminals and housing.

3. A relay as defined in claim 1; said bonding means comprising an epoxy resin applied directly to the terminals and housing.

4. A relay as defined in claim 1; means pivotally mounting said contact arm on said another of said terminals.

5. A relay as defined in claim 1; said another of said terminals being an integral member, and means pivotally mounting said contact arm on said another of said terminals.

6. A relay as defined in claim 1; said bonding means comprising an adhesive coating applied directly to said terminals and housing, said another of said terminals being an integral member, and means pivotally mounting said contact arm on said another of said terminals.

7. A relay as defined in claim 1; said bonding means comprising an epoxy resin applied directly to said terminals and housing, said another of said terminals being an integral member, and means pivotally mounting said contact arm on said another of said terminals.

8. A relay as defined in claim 1; said housing including an outwardly extending hollow boss into which an outer portion of one of said terminals projects, a conductor extending into said boss and connected to said outer portion, and insulation in said boss surrounding said outer portion and conductor.

9. A relay as defined in claim 1; said housing including an outwardly extending hollow boss into which an outer portion of one of said terminals projects, a conductor extending into said boss and connected to said outer portion, and insulation in said boss surrounding said outer portion and conductor and frictionally engaging and secured against the inner wall of said boss.

10. A relay as defined in claim 1; an outer portion of one of said terminals being a tapered pin, said housing including an outwardly extending hollow boss into which said tapered pin projects, a conductor extending into said boss and connected to said tapered pin, and insulation in said boss surrounding said tapered pin and conductor and forced laterally outwardly by said tapered pin into engagement with the inner wall of said boss.

11. A relay as defined in claim 1; said bonding means comprising an adhesive coating applied directly to said terminals and housing, said housing including an outwardly extending hollow boss into which an outer portion of one of said terminals projects, a conductor extending into said boss and connected to said outer portion, and insulation in said boss surrounding said outer portion and conductor.

12. A relay as defined in claim 1; said bonding means comprising an adhesive coating applied directly to said terminals and housing, said housing including an outwardly extending hollow boss into which an outer portion of one of said terminals projects, a conductor extending into said boss and connected to said outer portion, and insulation in said boss surrounding said outer portion and conductor and frictionally engaging and secured against the inner wall of said boss.

13. A relay as defined in claim 1; said bonding means comprising an adhesive coating applied directly to said terminals and housing, an outer portion of one of said terminals being a tapered pin, said housing including an outwardly extending hollow boss into which said tapered pin projects, a conductor extending into said boss and connected to said tapered pin, and insulation in said boss surrounding said tapered pin and conductor and forced laterally outwardly by said tapered pin into engagement with the inner wall of said boss.

14. A relay as defined in claim 1; said bonding means comprising an epoxy resin applied directly to the terminals and housing, said housing including an outwardly extending hollow boss into which an outer portion of one of said terminals projects, a conductor extending into said boss and connected to said outer portion, and insulation in said boss surrounding said outer portion and conductor and frictionally engaging and secured against the inner wall of said boss.

15. A relay as defined in claim 1; said bonding means comprising an epoxy resin applied directly to the terminals and housing, an outer portion of one of said terminals being a tapered pin, said housing including an outwardly extending hollow boss into which said tapered pin projects, a conductor extending into said boss and connected to said tapered pin, and insulation in said boss surrounding said tapered pin and conductor and forced laterally outwardly by said tapered pin into engagement with the inner wall of said boss.

16. A relay as defined in claim 1; said bonding means comprising an epoxy resin applied directly to the terminals and housing, said another of said terminals being an integral member, means pivotally mounting said contact arm on said another of said terminals, an outer portion of one of said terminals being a tapered pin, said housing including an outwardly extending hollow boss into which said tapered pin projects, a conductor extending into said boss and connected to said tapered pin, and insulation in said boss surrounding said tapered pin and conductor and forced laterally outwardly by said tapered pin into engagement with the inner wall of said boss.

17. A relay as defined in claim 1; an outer portion of one of said terminals being a tapered threaded pin, said housing including an outwardly extending hollow boss into which said pin projects, a conductor extending into said boss and threadedly connected to said threaded pin, and insulation in said boss surrounding said pin and conductor and threadedly connected to said threaded pin and forced laterally outwardly by said threaded pin into engagement with the inner wall of said boss.

18. A relay as defined in claim 1; said housing including outwardly extending bosses into which outer portions of said terminals project, a conductor extending into each boss and connected to an outer portion of an associated terminal, and insulation in each boss surrounding said outer portion and conductor.

19. A relay as defined in claim 1; said housing including outwardly extending bosses into which outer portions of said terminals project, a conductor extending into each boss and connected to an outer portion of an associated terminal, and insulation in each boss surrounding said outer portion and conductor, each of said outer portions being a tapered pin, said insulation in each boss being forced by said tapered pin laterally outwardly into engagement with the inner wall of such boss.

20. A relay as defined in claim 1; said housing including outwardly extending bosses into which outer portions of said terminals project, a conductor extending into each boss and connected to an outer portion of an associated terminal, and insulation in each boss surrounding said outer portion and conductor, each of said outer portions being a tapered threaded pin, each conductor being threadedly connected to an associated pin, said insulation in each boss being threadedly connected to said threaded pin and forced laterally outwardly by said pin into engagement with the inner wall of such boss.

* * * * *